United States Patent [19]

Ishizuka et al.

[11] Patent Number: 4,844,988

[45] Date of Patent: Jul. 4, 1989

[54] DIAMOND COMPOSITE AND METHOD FOR PRODUCING THE SAME

[75] Inventors: Hiroshi Ishizuka, Tokyo; Satoshi Hayakawa, Yokohama, both of Japan

[73] Assignee: The Ishizuka Research Institute, Ltd., Kanagawa, Japan

[21] Appl. No.: 136,281

[22] Filed: Dec. 22, 1987

[30] Foreign Application Priority Data

Sep. 1, 1987 [JP] Japan ..... 62-218562

[51] Int. Cl.[4] ..... B22F 3/00

[52] U.S. Cl. ..... 428/552; 419/9; 419/46; 419/48; 428/408; 428/621

[58] Field of Search ..... 428/408, 552, 621; 419/9, 48, 46

[56] References Cited

U.S. PATENT DOCUMENTS

| | | | |
|---|---|---|---|
| 4,219,199 | 8/1980 | Okuda | 204/192.15 |
| 4,694,918 | 9/1987 | Hall | 175/329 |
| 4,695,321 | 9/1987 | Akashi et al. | 75/243 |

*Primary Examiner*—Stephen J. Lechert, Jr.
*Attorney, Agent, or Firm*—Larson and Taylor

[57] ABSTRACT

A diamond composite combined with a cobalt-containing substrate, comprising: a sintered mass of diamond, in which practically all the diamond particles are joined immediately with adjacent particles, a mass of cobalt-containing carbide, said latter mass being larger than the former and said first and latter masses being of a same cross section at the opposed ends, and an intermediate layer of a solid material which consists of Mo, Co and C with a minor proportion of inevitable impurities and which comprises a molybdenum carbide exhibiting a melting point within 200 degrees C. of that of the first said carbide material, said layer intervening between the masses and having a total radial cross sectional area of at least 80% but not greater than 97% of that of the diamond mass and carbide masses at the joint and a thickness of, at least, 25 microns over the whole cross sectional area and method for producing the same.

5 Claims, No Drawings

DIAMOND COMPOSITE AND METHOD FOR PRODUCING THE SAME

The present invention relates to a diamond composite suitable to various applications where a high wear resistance and/or a high compression strength is required, including turning and other tool tipe, wire drawing die, and high pressure anvil.

Diamond-carbide composites, consisting of a layer of diamond particles interjoined immediately with each other and backed with a cemented carbide block, are favored and widely employed in various industries as an abrasive material for their excellent resistance to abrasion. They are produced by placing a mass of diamond particles and a block of cemented carbide in contact with each other, and subjecting the whole to a combined pressure-temperature condition where diamond is the thermodynamically favored morphology, so that an infiltrant metal may be provided in fused state and penetrate the diamond layer from an outside source or, alternatively, diffuse among the particles in case where the source is provided within. As effecting essential mechanical properties of the resulting products, some measures have been proposed for optimizing the volume of the metallic phase remaining among the diamond particles.

A solution is known from, for example, U.S. Pat. No. 4,440,573 to this Inventor, which employs a Ta foil intermediate layer placed between the diamond and WC-Co layers and serving as a barrier for suppressing and regulating the liquid metal infiltrant to pass from the latter to former. However, since the composite materials as recovered from the reaction process contain rather large stresses accumulated in particular at the interface of the diamond and WC-Co due to the difference in coefficient of thermal expansion between the two materials, when the raw composites, usually in circular form, are cut electromechanically into final shapes of sector or other forms, the high thermal imput involved with the machining process often triggers an axial cracking of the backing material.

On the other hand it is important, in order to achieve a good product yield in the machining, that the electromechanical process be operated at a substantially regular power input so that a smooth cut surface may be produced. However, this has been quite a hard task to be done with the products obtained by the above described process which essentially employs a thin layer of Ta placed betwen the diamond and carbide layers, as the intermediate layer is converted for the major part to a tantalum carbide, which has a melting point too high (3900 deg. C, approximately) and, thus, requires an excessive thermal imput relative to the WC (m.p.2600–2750 deg. C., approximately) portion of the composite; an irregularity thus caused in power imput often leaves a scarred surface, with the adjacent zones affected by such intense heat input, in addition to the above mentioned susceptibility to cracking. That all results in rather limited yields in machined products. The said USP suggests a possibility of the use of an alternative metallic material, such as molybdenum, for the intermediate layer, it fails to adequately describe the technique.

Therefore, one of the principal objects of the invention is to provide a sintered diamond and a method to produce the same, which permits a substantially regular power input for cutting in the electromechanical process to minimize the above mentioned problems involved in the production of the sintered diamond products and, thereby, an improved product recovery from the process.

According to the invention there is provided a diamond composite combined with a cobalt-containing substrate, comprising: a sintered mass of diamond, in which practically all the diamond particles are joined immediately with adjacent particles, a mass of cobalt-containing carbide, said latter mass being larger than the former and said first and latter masses being of a same cross section at the opposed ends, and an intermediate layer of a solid material which consists of Mo, Co and C with a minor proportion of inevitable impurities and which comprises a molybdenum carbide with the latter exhibiting a melting point within 200 degrees C. of that of the first said carbide material, said layer intervening between the masses and having a cross sectional area of at least 80% but not greater than 97% of that of the diamond and carbide masses at the opposed ends, and a thickness of, at least, 25 microns over the whole cross sectional area.

In the invention, the intermediate layer of metal, employed to regulate the influx of the infiltrant to the diamond layer, is carburized in part or wholly during the process. With molybdenum as the material, the metal is converted via, probably, an intermediate Mo-Co alloy phase, which should form by a reaction with fused cobalt and, finally, to carbides with carbon from the diamond or WC, said carbides typically exhibiting a melting point of some 2700 deg. C. together with rather small coefficients of thermal expansion: $7.8\times10^{-3}$ $1.6$ deg. $^{-1}$ as $Mo_2C$, in comparison with TaC exhibiting a melting point of 3900 deg. C. with a coefficient of $8.3\times10^{-6}$ deg.$^{-1}$. With rather a high wettability by the liquid cobalt, the molybdenum carbide shows a somewhat deteriorated barrier performance against the fused metal; thus it is of importance that the foil be given an initial thickness which ensures the function even when carburized to the maximum during the sintering process. The optimal thickness range depends principally on both the heating temeperature and time parameters. Anyway, the initial thickness should be at least 20 microns in order to achieve a well reproducible performance when practised on industrial scale, said thickness level being secured over an area of 80 to 97% of the radial cross sectional area of the joint, that is the diamond mass or WC at the opposed end. Thicker foils are disadvantageous in that, in addition to the increasing material cost, resulting composites, when treated with acid at the end of the machining process, produce a roughened unsmooth surface as locally and concentrically etched at the metallic portion. Thus the molybdenum layer should have a thickness not exceeding 250 microns when contained in the composite product and, for this purpose, the molybdenum foil thickness should not exceed some 200 microns initially, or before the application of the pressure.

The diamond composites of the invention are produced essentially by placing the molybdenum foil specified as above between the layers to be joined of diamond particles and WC-Co block of substantially a same sectional area, and treating the whole at a combined pressure-temperature parameters within the thermodynamic diamond stable region and where temperature is high enough for a cobalt-based liquid to be formed in the WC-Co portion and supplied therefrom to the diamond.

In the sintering process there is typically an increase of some 20% in thickness of the foil as a result of reactions with cobalt and/or carbon, so the foil finally may exhibit a thickness of some 25 to 250 microns.

Now the invention will be described more in particular in reference with an Example which follows:

EXAMPLE

A 9.2 mm. I.D. cylindrical vessel of tantalum was loaded of 0.1 gram of 5–12 micron diamond powder, an 8.9 mm. across circular molybdenum sheet with a substantially regular thickness of 0.1 mm., and a 9.1 mm. across, 1.7 mm. thick green compact of WC-Co in consecutive layers. Closed with a tantalum sheet closure, the whole was mounted on a high pressure-high temperature apparatus and subjected to a pressure of 6 GPa and, simultaneously, a temperature of 1400 deg. C. for 5 minutes in order to complete the sintering. The product as recovered of a hardness level ranging from 6000 to 6500 kg/sq.mm. on the diamond surface, was successfully cut with a normal electromechanical technique; the eight 45-deg. sector pieces were, each, of marketable quality completely free of any cracks or roughened surface.

REFERENCE

The process as described above was repeated, except that the molybdenum sheet was replaced with a 0.05 mm. thick tantalum sheet of the same cross sectional area. The product exhibited a hardness level comparable to that of the above said example. In the cutting process, however, it yielded only four marketable sector pieces, with the rest of four suffering from microcracking.

As may be apparent from the above given description the sintered diamond composite of the invention exhibits the advantage in particularity in that, due to the improved machinability it permits an increased yield of marketable products in the cutting process.

We claim:

1. A diamond composite combined with a cobalt-containing substrate, comprising: a sintered mass of diamond, in which practically all the diamond particles are joined immediately with adjacent particles, a mass of cobalt-containing carbide, said latter mass being larger than the former and said first and latter masses being of a same cross section at the opposed ends, and an intermediate layer of a solid material which consists of Mo, Co and C with a minor proportion of inevitable impurities and which comprises a molybdenum carbide exhibiting a melting point within 200 degrees C. of that of the first said carbide material, said layer intervening between the masses and having a total radial cross sectional area of at least 80% but not greater than 97% of that of the diamond mass and carbide masses at the joint and a thickness of, at least, 25 microns over the whole cross sectional area.

2. A composite as claimed in claim 1, in which said intermediate layer material comprises metallic molybdenum.

3. A composite as claimed in claim 1, in which said intermediate layer thickness is not greater than 250 microns.

4. A method for producing a diamond compact, comprising placing a loose mass of diamond particles in close contact with- but separated by a sheet of molybdenous material from a substrate block of cobalt-containing carbide material, said block having a sectional area substantially identical to- and a volume greater than said mass, said sheet having an effective sectional area 80 to 97% as wide as said masses at the opposed ends and a thickness of, at least, 20 microns over said area, heating the whole to a temperature high enough to yield a cobalt-based melt within said carbide material, allowing a limited mass of the melt, regulated by the sheet, to pass and infiltrate the diamond particles, thus initiating an interjoining of the diamond particles and a joining of the particles as a whole with the carbide material, converting partly the molybdenum sheet to a molybdenum carbide of a melting point within 200 deg. C. of that of the first said carbide material, while maintaining a combined pressure-temperature condition within the thermodynamic stability region for diamond, and recovering an integrated composite product thus produced.

5. The method as claimed in claim 4, in which said sheet, prior to the application of the pressure and temperature, has a thickness no greater than 200 microns.

* * * * *